US006237571B1

(12) United States Patent
Harrison

(10) Patent No.: US 6,237,571 B1
(45) Date of Patent: May 29, 2001

(54) APPARATUS AND METHOD FOR CONNECTING A FUEL PRESSURE TUBE TO A FUEL INJECTOR OF AN INTERNAL COMBUSTION ENGINE

(75) Inventor: Mark Harrison, Northampton (GB)

(73) Assignee: Perkins Engines Company Limited, Peterborough (GB)

( * ) Notice: Subject to any disclaimer, the term of this patent is extended or adjusted under 35 U.S.C. 154(b) by 0 days.

(21) Appl. No.: 09/380,360

(22) PCT Filed: Dec. 23, 1998

(86) PCT No.: PCT/GB98/03906

§ 371 Date: Aug. 26, 1999

§ 102(e) Date: Aug. 26, 1999

(87) PCT Pub. No.: WO99/35393

PCT Pub. Date: Jul. 15, 1999

(30) Foreign Application Priority Data

Dec. 30, 1997 (GB) ..... 972742

(51) Int. Cl.[7] ..... F02M 55/02
(52) U.S. Cl. ..... 123/469; 123/198 D
(58) Field of Search ..... 123/469, 468, 123/470, 198 D; 285/14

(56) References Cited

U.S. PATENT DOCUMENTS

| | | | | |
|---|---|---|---|---|
| 3,612,577 | * | 10/1971 | Pope et al. | 285/14 |
| 3,845,748 | | 11/1974 | Eisenberg | 123/32 |
| 4,384,557 | * | 5/1983 | Johnson | 123/198 D |
| 4,445,713 | * | 5/1984 | Bruning | 285/14 |
| 4,485,790 | | 12/1984 | Nishimura et al. | 123/468 |
| 4,715,103 | * | 12/1987 | Jaksa et al. | 29/156.4 |
| 4,887,955 | * | 12/1989 | Maruyama et al. | 417/501 |
| 5,365,907 | | 11/1994 | Dietrich et al. | 123/470 |

FOREIGN PATENT DOCUMENTS

| | | |
|---|---|---|
| 44 27 717 | 8/1995 | (DE) . |
| 925937 | 5/1963 | (GB) . |
| 2 310 892 | 9/1997 | (GB) . |

* cited by examiner

*Primary Examiner*—Henry C. Yuen
*Assistant Examiner*—Mahmoud M Gimie
(74) *Attorney, Agent, or Firm*—Alan J. Hickman

(57) ABSTRACT

An apparatus and a method for connecting a fuel pressure tube to a side feed injector device of an internal combustion engine providing a conduit for leak-back transfer from the injector to a take-off point for return to the fuel feed system having a holder for fitting onto an injector body and serving to receive a fuel pressure tube, a housing member configured to cooperate with the holder to define a leak-back receptacle, and ducts to enable communication of a leak-back flow of fuel from the injector and to enable controlled delivery of the leak-back fuel for re-use.

19 Claims, 2 Drawing Sheets

APPARATUS AND METHOD FOR CONNECTING A FUEL PRESSURE TUBE TO A FUEL INJECTOR OF AN INTERNAL COMBUSTION ENGINE

BACKGROUND OF THE INVENTION

1. Field of the Invention

The present invention relates to a fuel feed apparatus and, in particular, a high pressure fuel feed connection to a fuel injector in an internal combustion engine to provide a conduit for leak-back fluid, a method for fitting such apparatus and an engine including said apparatus.

High pressure fuel injection systems used in, for example, diesel engines may be of the type in which the fuel is provided to the injectors from a "common rail" (a high pressure fuel manifold from which fuel for injection is taken off upon demand from the injector). In such systems it can be convenient, to limit engine height or for other reasons, to pass fuel from the rail via a pressure tube into a port in a side face rather than an upper face of the injector.

The upper part of an injector of the aforementioned type will often be enclosed within the body of the cylinder head but it may be necessary for it to be contained within an enclosure such as a camshaft housing above the cylinder head, particularly where the cylinder head is of shallow height in order to limit engine height and/or weight.

Several problems may arise in connecting a side feed to an injector in the above mentioned systems. In particular, fuel leaking from the vicinity of the injector connection may mix with and dilute engine lubricating oil carried within or above the cylinder head. This problem is exacerbated in that the leakage will normally be out of the sight of the engine operator.

Further problems arise with injectors of this type in that side forces may be imparted to the injector body which may cause deformation of the body and hence sticking of the injector moving parts. This situation can be particularly severe where the engine design does not readily permit the upper part of the injector to be directly supported by the cylinder head.

A further problem is the angular or lateral misalignment that can occur at the interface between the fuel feed conduit and the injector body. A rigid connection having limited means for correction of mis-alignment or tolerance build-up may lead to exacerbated fuel leakage at the interface and/or stress either at the connection or within the injector body.

2. Description of the Related Art

The problem in making a secure and leak-proof fuel feed connection to a side feed injector has been addressed in prior art. For example, U.S. Pat. No. 5,365,907 discloses a side feed connection to an injector in which arrangement a pressure tube is located in a recess in the cylinder head so that an inner end seats against a fuel inlet port in the injector and the tube is forced into firm engagement with the injector by a threaded tube-nut screwed into the cylinder head. The outer end of the tube extends through the tube-nut and is terminated in a means for securing a fuel supply pipe.

Patent application GB 2310891-A discloses a similar arrangement wherein a pressure tube having a frusto-conical collar is forced into engagement with the injector by a loose flange which bears on the collar and is retained to the cylinder head by threaded fasteners. Patent application JP 08-144886-A discloses a further arrangement in which a pressure tube passes through a passage in the cylinder head and into engagement with the injector and is terminated at an outer end by a flange. However none of the prior art discloses an injector side feed apparatus which would be suitable for fitment above, rather than within, the body of a cylinder head.

In cases where, for example, the space take within the cylinder head by the gas exchange mechanism leaves insufficient room for fitment of an injector side feed connection, or the cylinder head has only a shallow height, it may be convenient instead to make the connection above the cylinder head. In such cases, there would not be available the direct support of an upper part of the injector by the body of the cylinder head to resist the side forces which may be imparted by attachment of conventional side feed connections and this could result in bending of the injector.

In addition to a fuel feed, fuel leak-back provision is required with several common-rail injection systems because a portion of the fluid supplied is used in controlling the internal operation of and/or cooling of the injector and is then returned to the fuel feed system. It is otherwise known for fuel leak-back from an injector to be provided by direct communication between a relatively low leak-off port in an injector communicating with passages within a cylinder head but the long, small diameter, drillings in a cylinder head for this provision may be difficult to machine.

Patent DE 4427717-C1 teaches an apparatus capable of making a fuel feed connection to a side of an injector at a point above a main body of a cylinder head and due to the sliding nature of the connection side loading of the injector body can be minimised or avoided. However, there is no provision of appropriate means for fuel leak-back from the injector to a take-off point, and the leak-back path disclosed is of relatively high resistance, due to the presence of a threaded portion.

OBJECTS AND SUMMARY OF THE INVENTION

It is an object of the present invention to provide an apparatus and method for secure fuel leak-back transfer from a side feed injector to a take-off point for return to the fuel feed system, and especially to provide an apparatus and method for transferring fuel leakage from a high pressure side feed injector connection to a low pressure leak-back means for re-use, whilst introducing minimal additional side loading to the injector body.

It is a further object of the present invention to provide an apparatus and a method enabling the connection of a pressure tube to a side feed injector at a position above the body of a cylinder head and in a manner which will avoid or mitigate side loading of the injector.

It is a further object of the present invention to provide an apparatus and a method which includes a means to facilitate precise alignment between the pressure tube and the inlet port of the injector.

According to a first aspect of the invention, an apparatus for connecting a fuel pressure tube to a side feed injector device of an internal combustion engine, said injector device including an injector body having a fuel feed aperture on a side wall, comprises holder means for fitting onto an injector body serving to receive a fuel pressure tube, a housing member for said holder means configured to co-operate in use with said holder means to define a leak-back receptacle, ductings being provided in said holder means and said housing member to enable communication of a leak-back flow of fuel from the injector to the leak-back receptacle, and discharge means being provided in the receptacle to enable controlled delivery of the leak-back fuel for re-use.

The apparatus thus provides a simple and relatively direct fuel leak-back transfer for fuel emitted from the side feed injector to a take-off point for return to the fuel feed system. The apparatus is particularly suited to transferring leak-back fuel from a high pressure side feed injector connection to a low pressure leak-back means for re-use.

Preferably the housing member comprises a main support member adapted to be secured to a body part of the internal combustion engine and a carrier member for the holder device adapted to be secured to the main support member such that the holder device is movable in the carrier member, whereby the holder device can be fitted on to the injector body so as to take up an operative position whereat the nose portion of the fuel pressure tube is seated at the fuel feed aperture on the side wall of the injector body so that the holder device is retained on the injector body but with relative movement possible between the holder device and the carrier member.

Such an arrangement facilitates controlled loading of the pressure tube in the operative position and the securing of an effective seal whilst minimising excessive side-loading of the injector body Preferably the holder device comprises a sleeve portion for axial fitting on the injector body and a branch portion to receive the fuel pressure tube and the housing member is configured to support the holder device via the branch portion and to co-operate with the branch portion in use to define the leak-back receptacle.

Preferably the main support member includes an aperture and the carrier member includes a nose portion projecting through this aperture, the branch portion of the holder device being movably located in the nose portion.

To facilitate efficient sealing and the provision of a secure leak back receptacle and conduit for leakage fuel the branch portion of the holder device conveniently comprises a plurality of spaced annular flanges each having an annular recess to receive a sealing ring engaging an internal bore in a nose portion of the carrier member, wherein an annular volume defined between the spaced annular flanges constitutes the leak-back receptacle. A further sealing ring may be provided between the fuel pressure tube and the branch portion of the holder device.

Preferably the branch portion includes a threaded part for threadingly receiving the fuel pressure tube whereby the pressure tube can be brought into leak proof engagement with the side aperture of the injector body.

The annular volume defined between the spaced annular flanges constitutes a receiving chamber for fuel leak back from the injector body: suitable ducting will be present to permit leak back flow from the body to said receiving chamber, and discharge means, for example as a discharge port in the carrier member, will be present for outflow of fluid from the chamber.

Preferably the discharge means is adapted to receive a conduit for said delivery of the leak-back fuel. The discharge means preferably opens laterally relative to the fuel pressure tube.

In one preferred embodiment, the main support member is releasably fitted to the cylinder head of the I.C. engine with the aperture in the support member only slightly larger in cross section than the nose portion of the carrier member. In this embodiment, for the fitting of the holder device in the injector body, the main support member is moved with the holder device from a position free of the cylinder head to enable the holder device to occupy the said operative position whereupon the main support member can be secured to the cylinder head.

In an alternative embodiment, the main support member is integral with the cylinder head of the I.C. engine and the aperture in the main support member is of sufficient size to enable the holder device to be moved individually from a position free of the injector body to said operative position on the body. Preferably the carrier member includes a flange part to facilitate the fitting of the carrier member to the main support member.

The sleeve portion of the holder device is preferably slightly oversize relative to the injector body and includes spaced seal means for sealingly engaging the injector body on either side of the side aperture on the body.

The carrier member can be secured to the main support member by fastener elements, and the adjustment means preferably comprise means for permitting lateral movement of the carrier member relative to said fastener elements. More especially the fastener elements preferably comprise screws extending through bores in the carrier member, and the bores can slightly oversize relative to the screws to permit said lateral movement.

Preferably the side aperture of the injector body has an annular wall of tapering configuration for seating of the pressure tube nose. The taper of the side aperture can have an included angle greater than that of the nose portion of the pressure tube whereby a corner of the tube can deform under load when engaging said annular wall to encourage sealing integrity at the aperture. Further adjustment is possible by providing a certain lateral adjustability between the holder device and the carrier member.

According to a further aspect of the present invention an apparatus is provided for connecting a fuel pressure tube to a side-feed injector device of an internal combustion (I.C.) engine, said injector device including an injector body having a fuel feed aperture on a side wall, said apparatus comprising a main support member carried by or adapted to be carried by a body part of the I.C. engine, especially by the cylinder head of the engine, a holder device for the fuel pressure tube adapted to fit onto said injector body, a carrier member for the holder device adapted to be secured to said main support member the holder device being movable in said carrier member, and means to seat a nose portion of the pressure tube at the side aperture of the injector body, the arrangement being such that with the injector device located on the I.C. engine the holder device can be fitted onto the injector body via the outer or top end of the injector device so as to take up an operative position whereat the nose portion of the fuel pressure tube is seated at the fuel feed aperture on the side wall of the injector body so that the holder device is retained on the injector body, but with relative movement possible between the holder device and the carrier member.

The present invention is also an internal combustion engine provided with the above described apparatus.

According to a further aspect of the present invention there is provided a method of connecting a fuel pressure tube to a side-feed injector of an internal combustion engine so as to provide a leak-back path for conducting away leak-back fuel issuing out of the injector, the method comprising the steps of: providing a holder device for receiving a pressure tube; locating a holder device for the pressure tube in an operative position on the injector body, supporting the holder device in a housing means provided with fixing means. to secure the housing means to the engine when the holder device is in the operative position, locating the pressure tube in the holder device and causing the pressure tube to seat at the side aperture so as to provide a fluid communication between the injector and the discharge means via a leak-back receptacle.

In a preferred embodiment of this method, the housing member comprises a main support member and a carrier member for the holder device, the main support member is secured to a body part of the internal combustion engine, the carrier member is secured to the main support member and supports the holder device such that the holder device is movable in the carrier member, and the holder device is thereby located in position onto the injector body in an operative position whereat a nose portion of the fuel pressure tube is seated at the fuel feed aperture on the side wall of the injector body so that the holder device is retained on the injector body but with relative movement possible between the holder device and the carrier member.

Preferably, for accuracy of engagement and control of side-loading, the pressure tube is seated at the side aperture of the injector body by use of adjustment means provided between the carrier member and main support member to enable controlled relative movement thereof.

Other preferred features of the method will be apparent to the skilled person from the embodiments of the apparatus described herein.

According to a further aspect of the present invention there is provided a method of connecting a fuel pressure tube to a side-feed injector of an I.C. engine at a position above the cylinder head of the engine: said method comprising the steps of providing a holder device for the pressure tube, supporting the holder device on a carrier member, fitting the holder device to the body of the injector device so as to locate the device in an operative position on the injector body, securing the carrier member while supporting the holder device to a main support member joined to the I.C. engine, and causing the pressure tube to seat at a feed aperture on the side wall of the injector body when supported by the holder device in the operative position so that the holder device is retained on the injector body while permitting relative movement between the holder device and the carrier member to avoid or mitigate against side loading on the injector device.

BRIEF DESCRIPTION OF THE DRAWINGS

By way of example, embodiments of the present invention will now be described with reference to the accompanying drawings wherein.

DESCRIPTION OF THE PREFERRED EMBODIMENTS

Figure 1:
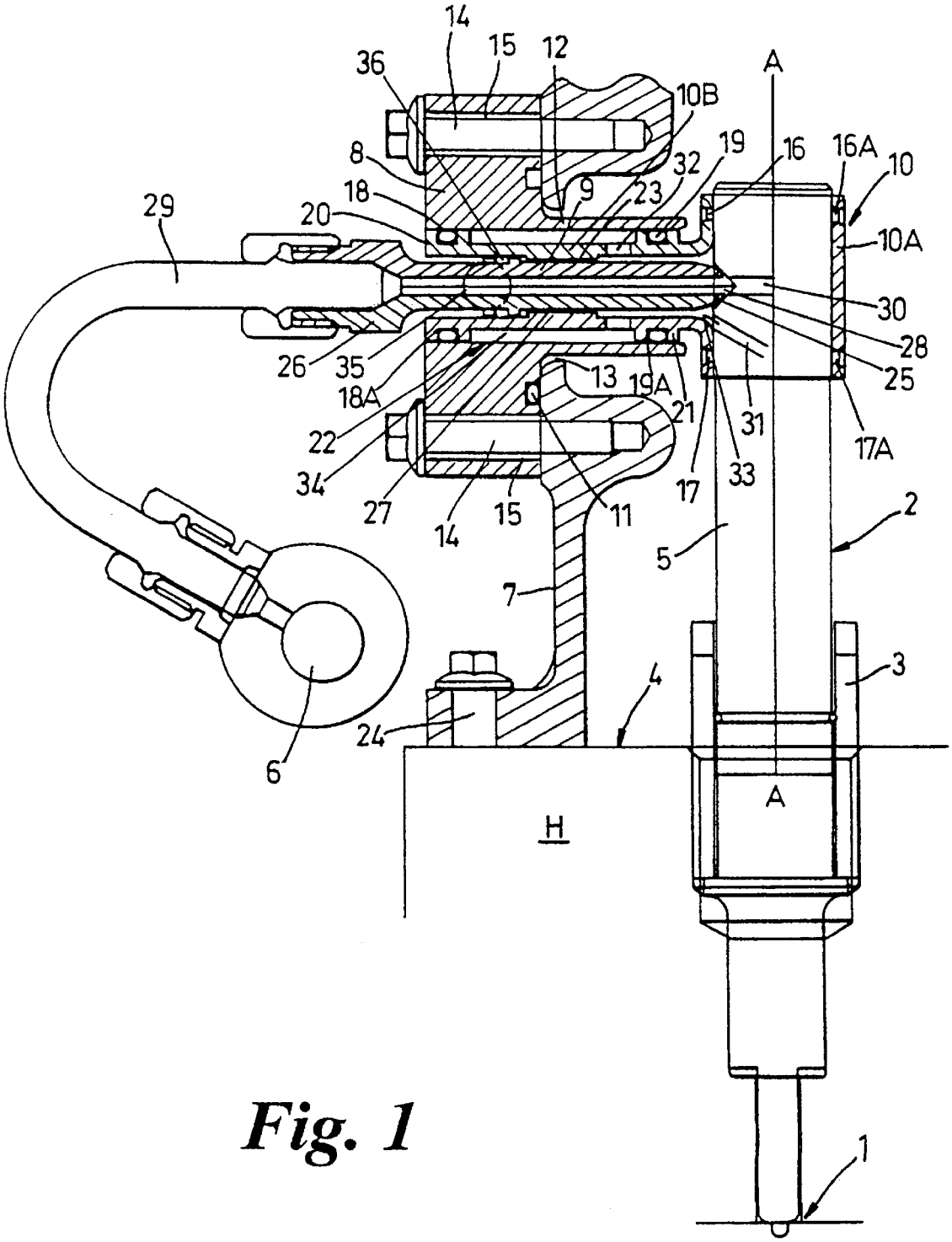
FIG. 1 is a cross-sectional side view through the apparatus of a first embodiment of the present invention in which fitment to an engine may be generally from above the injector.

Referring to the drawings, FIG. 1 shows part of a cylinder head H, fitted to an engine, in which a nozzle end 1 of a fuel injector 2 is retained by a castellated nut 3. In this example, the cylinder head H is of a shallow construction in order to minimise its mass and it therefore has a relatively low top face 4 with the result that an upper end of the injector body 5 extends significantly above the cylinder head.

A conventional common rail 6 is located above and to a side of the cylinder head H. The common rail 6 is provided with fuel at a suitable pressure e.g. up to 1600 bar by a pump (not shown).

A frame 7 defining a main support member, which may be specific to the apparatus of the invention or may include containment means for other parts of the engine such as a camshaft (not shown), is prepared before fitment to the engine by assembling to it in a manner to be described a leak-back housing 8 defining a carrier member for a holder of fuel pressure tube 9, the holder being in the form of a tee 10 to be described.

The leak-back housing 8 is prepared by the fitment of a sealing ring 11 in a groove adjacent to, but spaced apart from a nose 12 of the housing. The housing 8 is then positioned on the frame 7 so that the nose 12 passes through an aperture 13 in the frame 7. The housing 8 is loosely secured to the frame with threaded fasteners 14. To provide some positional adjustability at a later stage, the frame. aperture 13 is oversized with respect to the nose 12 and the housing 8 has oversized fastener holes 15 for the fasteners (screws) 14.

The tee 10 is prepared by the fitment of two sealing rings 16, 17 into spaced apart grooves 16A, 17A inside a sleeve portion 10A of the tee and a further two sealing rings 18, 19 into spaced apart grooves 18A, 19A on spaced flanges 20, 21 on a tubular branch portion 10B of the tee. The tee 10 is then fitted into a passage 22 in the leak-back housing with the sleeve 10A in a nominally perpendicular attitude, the tee 10 being frictionally retained in this position by the sealing rings 18, 19. The branch 10B of the tee 10 carries a screw thread 23 for a nominal quarter of the length of its internal passage. A sealing sealing ring 36 is present between the tube 9 and the branch 10B.

The sleeve 10A of the tee 10 has an internal diameter very slightly larger than an outside diameter of the injector body 5 so that, when it is subsequently fitted to the injector as shown, close fitment of the sleeve to the injector will minimise deformation of the sealing rings 16, 17.

The frame 7, complete with leak-back housing 8 and tee 10, is lowered into position on the cylinder head during which operation the sleeve 10A of the tee is brought into sliding engagement with the injector body 5. When the frame 7 is in position on the cylinder head H, it is retained thereto by threaded fasteners 24; fastening occurring when. the tee 10 is in the operative position shown in FIG. 1.

The pressure tube 9 has a frusto-conical seat 25 at a first end, a hexagonal head 26 at a second end and an external thread 27 approximately midway along its length and is screwed into the branch 10B of the tee 10 until the first end 25 commences to engage a recess 28 in the injector body Coincident with the pressure tube 9 being brought into firm engagement with the recess 28, the leak-back housing 8 may be slidably eased by hand relative to the frame 7 to ensure optimum alignment between the first end 25 of the pressure tube and the recess 28.

The pressure tube 9 is then tightened in the tee 10 sufficiently to ensure a leak-free connection between the first end 25 of the pressure tube and the injector 2. Preferably the recess 28 in the injector has a conical or frusto-conical configuration of greater included angle than the first end 25 of the pressure tube 9 to provide a sharp corner which will deform under load to ensure sealing integrity.

The leak-back housing 8 can be rigidly clamped to the frame 7 by tightening the threaded fasteners 14. Thus the tee 10 is securely fitted to the injector without including any detrimental side loading as the branch 10B can move in the passage 22 of the housing 8.

A conduit 29 may now be connected from the common rail 6 to the second end 26 of the pressure tube 9. Fuel will flow through the conduit 29 and the pressure tube and hence into a feed passage 30 within the injector, the feed passage 30 being a fluid communication with the recess 28.

Any movement of the frame 7 or other components in a direction normal to the axis A—A of the injector 2, due for example to thermal expansions, will be compensated by axial movement between the leak-back housing 8 and the branch 10B of the tee. Any very slight movement that may be experienced in other directions will be absorbed by deformation of the sealing rings 18, 19 between the branch 10B of the tee and the leak-back housing 8, a small clearance existing between the flange 20, 21 and the passage 22.

It will be seen that the configuration of the above apparatus allows leak-back fuel to exit the injector 2 via passages 31, 32 providing fluid communication between a leak-back port 33 in the injector and a volume 34 enclosed between the leak-back housing 8 and that part of the branch of the tee which is defined by the two flanges 20, 21. A passage 35 connects the volume 34 with a conventional leak-back take-off connection (now shown) in the leak-back housing. The leak-back ducting within the connection apparatus to the volume 34 defines a path of relatively low resistance, so encouraging the leak-back fuel to flow to the volume 34.

A second embodiment of the invention will now be described with reference to FIG. 2. In this embodiment, the apparatus is configured for fitting to a frame 7 which is an integral part of the cylinder head H or which has already been secured to the cylinder head. The need for this embodiment may arise, for example, where the frame 7 is defined by a wall extending from the cylinder head H and is not separable therefrom.

The apparatus of this embodiment differ from that illustrated in FIG. 1 insofar that in a generally upper portion of the drain-back housing 8, a generally upper portion of the sealing ring 11 and a generally upper portion of the aperture 13 in the frame are each extended in a direction away from the cylinder head H for a distance the approximate extent of which will become clear from the explanation below.

The order of assembly of the apparatus differs from that of the first embodiment insofar that, after fitment of the injector 2 to the cylinder head H, the tee 10, complete with sealing rings, is inserted through the elongated aperture 13 of the frame 7 and the sleeve 10A is slidably engaged with the injector body 5 to occupy the operative position. The aperture 13 must extend sufficiently distant from the cylinder head to permit the sleeve 10B to clear the injector 2 before it is brought into engagement. The tee 10 is shown dashed in FIG. 2 in a position free of the injector body 5, and as initially inserted through the aperture 13.

The leak-back housing 8 is dimensioned such that, when in position against the frame 7, the sealing ring 11 fitted to it will enclose the aperture 13. The housing 8, complete with sealing ring 11, is firstly positioned with the nose 12 facing towards the aperture and in line with the branch 10B of the tee. The nose 12 of the housing is then passed through the aperture 13 with the bore 22 of the housing being brought into engagement with the sealing rings 18, 19 on the branch 10B o+f the tee. The housing 8 is pressed home against the frame 7 and loosely secured in this position by the threaded fasteners 14. The pressure tube 9 is then screwed into the branch 10B of the tee. The leak-back route of the above examples of the present invention avoids long, small diameter drillings and their associated terminations in a cylinder head, and the passage to the volume 34 defines a path of relatively low resistance, the radial passage 32 in the tee portion 10B being in front of the threading 23 so encouraging leak-back fuel flow to the volume 34.

Figure 2:
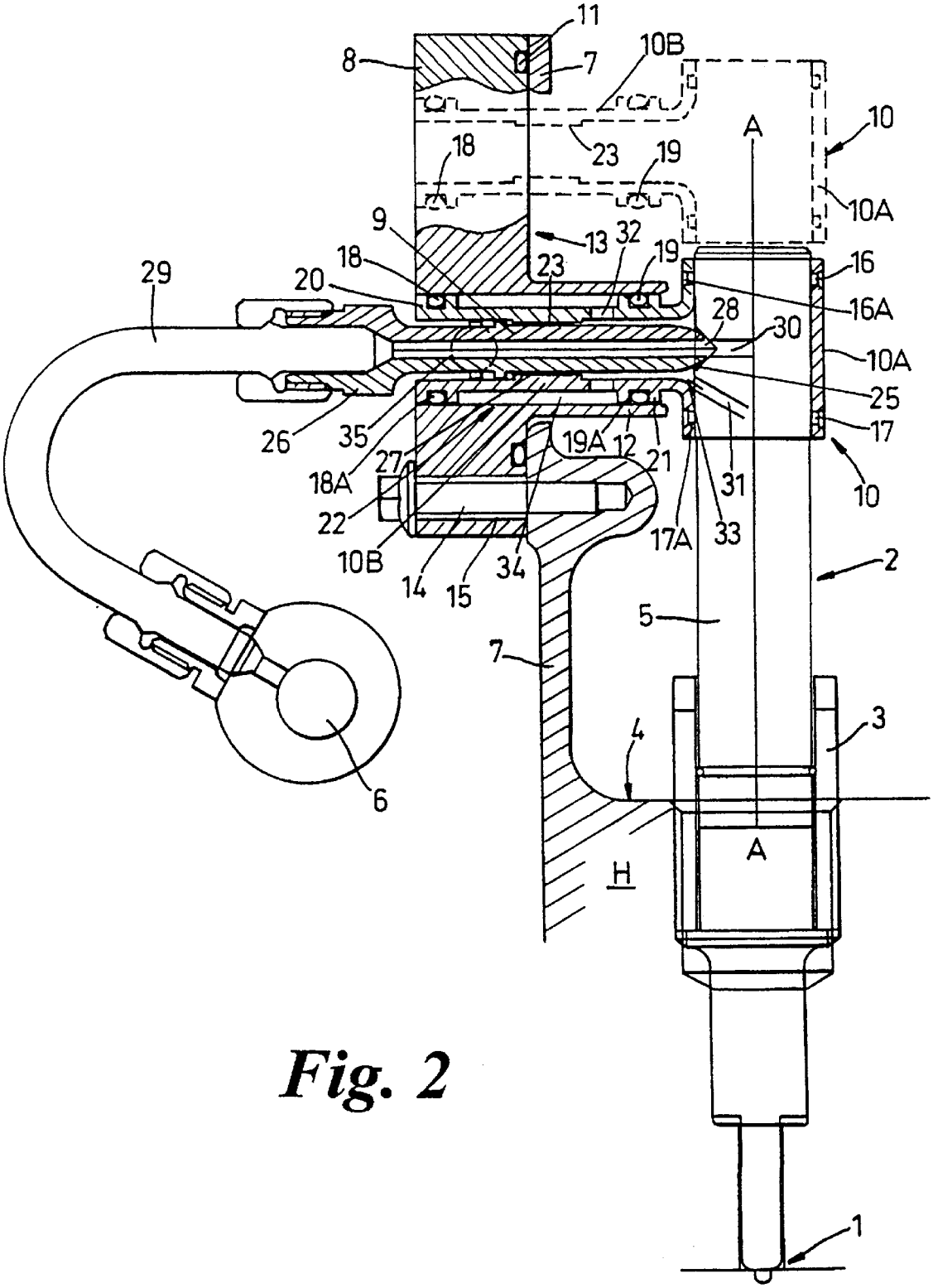
FIG. 2 is a cross-sectional side view through the apparatus of a second embodiment of the invention to facilitate fitment to an engine where access from above the injector is obstructed, or where the frame (main support member) is defined by a wall extending from the cylinder head.

The remainder of the assembly procedure for the second embodiment of FIG. 2 is identical to that of the first embodiment.

Modifications are of course possible in the above described examples of the present invention. For example, the tee 10 could have the branch portion 10B or least part of the branch portion 10B releasable from the remainder of the tee, such that said remaining part of the tee could be fitted from above to the injector body 5 so removing the need to pass the complete tee through the aperture 13 as in FIG. 2, the removable branch part being fitted to the remainder of the tee, in the operative position via the aperture 13, say by a screw threaded connection.

What is claimed is:

1. An apparatus for connecting a fuel pressure tube to a side feed injector device of an internal combustion engine, comprising:

an injector body having a fuel feed aperture disposed in a side wall of said injector body, said aperture being transverse the injector body;

a fuel pressure tube being seatingly engageable with the side wall of said body and in fluid passing communication with said fuel feed aperture;

a holder being connected to said injector body and supporting the fuel pressure tube in forcible seated transverse engagement with the side wall of the body and in fluid passing communication with the fuel feed aperture;

a housing member being connected to said internal combustion engine and supporting said holder, said housing member defining a leak-back receptacle with said holder; and a ducting being provided in said holder to communicate a leak-back flow of fuel from the injector to the leak-back receptacle.

2. An apparatus as claimed in claim 1 wherein the housing member comprises a main support member adapted to be secured to a body part of the internal combustion engine and a carrier member for the holder device adapted to be secured to the main support member such that the holder device is movable in the carrier member, whereby the holder device can be fitted on to the injector body so as to take up an operative position whereat the nose portion of the fuel pressure tube is seated at the fuel feed aperture on the side wall of the injector body so that the holder device is retained on the injector body but with relative movement possible between the holder device and the carrier member.

3. An apparatus as claimed in claim 2 wherein the main support member is adapted to be carried by the cylinder head of an internal combustion engine.

4. Apparatus as claimed in claim 1 wherein the holder device comprises a sleeve portion for axial fitting on the injector body and a branch portion to receive the fuel pressure tube and the housing member is configured to support the holder device via the branch portion and to co-operate with the branch portion in use to define the leak-back receptacle.

5. An apparatus as claimed in claim 4 wherein the main support member includes an aperture and the carrier member includes a nose portion projecting through this aperture, the branch portion of the holder device being movably located in the nose portion.

6. Apparatus as claimed in claim 5 wherein the branch portion of the holder device comprises a plurality of spaced annular flanges each having an annular recess to receive a sealing ring engaging an internal bore in the nose portion of the carrier member, wherein an annular volume defined between the spaced annular flanges constitutes the leak-back receptacle.

7. An apparatus as claimed in claim 6 wherein a further. sealing ring is provided between the fuel pressure tube and the branch portion of the holder device.

8. An apparatus as claimed in claim 4 wherein the branch portion includes a threaded part for threading the receiving the fuel pressure tube whereby the fuel pressure tube can be brought into leak proof engagement with the fuel feed aperture of the injector body.

9. An apparatus as claimed in claim 6 wherein a discharge port is located in the carrier member for outflow of fluid from the leak-back receptacle.

10. An apparatus as claimed in claim 1 wherein adjustment means are provided between the carrier member and main support member to facilitate accurate seating of the pressure tube at the side aperture of the injector body.

11. An apparatus as claimed in claim 10 wherein the carrier member is secured to the main support member by fastener elements, and the adjustment means comprise means for lateral movement of the carrier member relative to said fastener elements.

12. An apparatus as claimed in claim 11 wherein the fastener elements comprise screws extending through bores within the carrier member, and the bores are slightly oversized relative to the screw to permit said lateral movement.

13. An apparatus as claimed in claim 10 wherein the said side aperture of the injector body has an annular wall of tapering configuration for seating of a nose portion of the pressure tube.

14. An apparatus as claimed in claim 13 wherein the taper of the side aperture has an included angle greater than that of the nose portion of the pressure tube whereby a corner of the tube is deformed under load when engaging said annular wall to encourage sealing integrity at the aperture.

15. An apparatus as claimed in claim 14 wherein the discharge means opens laterally relative to the fuel pressure tube.

16. An apparatus as claimed in claim 15 wherein the discharge means is adapted to receive a conduit for said delivery of the leak-back fuel for reuse.

17. A method of connecting a fuel pressure tube to an injector of an internal combustion engine having a fuel feed aperture disposed in a side wall of a body of the injector and providing a leak-back path for conducting away leak-back fuel issuing out of the injector, the method comprising the steps of:

providing a holder device for receiving a pressure tube;

locating the holder device for the pressure tube in a predetermined operative position on the injector body and relative to the fuel feed aperture disposed in the side wall of the injector body;

fixing a housing to the engine;

supporting the holder device in the housing when the holder device is in the operative position, said housing means being secured to the engine;

locating the pressure tube in the holder device transverse to the injector body and causing the pressure tube to seat in forcible engagement with the side wall and in fluid passing alignment with the side aperture providing fluid communication between the injector body and a volume defined by the holder device and the housing.

18. A method as claimed in claim 17 wherein the housing member comprises a main support member and a carrier member for the holder device, the main support member is secured to a body part of the internal combustion engine, the carrier member is secured to the main support member such that the holder device is movable in the carrier member, and the holder device is thereby located in position onto the injector body in an operative position whereat the nose portion of the fuel pressure tube is seated at the fuel feed aperture on the side wall of the injector body so that the holder device is retained on the injector body but with relative movement possible between the holder device and the carrier member.

19. A method as in claim 18 wherein the pressure tube is seated at the side aperture of the injector body by use of adjustment means provided between the carrier member and main support member to enable controlled relative movement thereof.

* * * * *